US005743505A

United States Patent [19]

Sofy

[11] Patent Number: 5,743,505

[45] Date of Patent: Apr. 28, 1998

[54] BASE EXTENSION FOR TREE OR DISPLAY STAND

[75] Inventor: Hugh M. Sofy, Troy, Mich.

[73] Assignee: HMS Mfg. Co., Troy, Mich.

[21] Appl. No.: 543,878

[22] Filed: Oct. 19, 1995

[51] Int. Cl.[6] ..... A47G 29/00

[52] U.S. Cl. ..... 248/346.01; 248/346.03; 248/519

[58] Field of Search ..... 248/346.01, 346.03, 248/346.3, 519, 523, 231.61, 165, 529, 500, 146, 154

[56] References Cited

U.S. PATENT DOCUMENTS

| | | | |
|---|---|---|---|
| 1,350,970 | 8/1920 | Hutchison et al. . | |
| 2,713,471 | 7/1955 | Hirsch . | |
| 2,880,951 | 4/1959 | Springer | 248/154 X |
| 3,003,646 | 10/1961 | Wolf | 248/230.5 X |
| 3,030,720 | 4/1962 | Osswald et al. . | |
| 3,099,244 | 7/1963 | Knapp . | |
| 3,310,266 | 3/1967 | Larkin et al. | 248/154 |
| 3,733,040 | 5/1973 | Rocquin . | |
| 3,788,584 | 1/1974 | Deike | 248/154 |
| 4,031,689 | 6/1977 | Sullivan | 248/97 X |
| 4,079,907 | 3/1978 | Mykleby | 248/346.3 X |
| 4,991,811 | 2/1991 | Portnoy | 248/346.01 |
| 5,263,668 | 11/1993 | Reiter | 248/346.01 |
| 5,338,799 | 8/1994 | Keefe | 248/519 |
| 5,340,075 | 8/1994 | Schriner | 248/346.01 |
| 5,354,031 | 10/1994 | Bilotti . | |

FOREIGN PATENT DOCUMENTS

| | | | |
|---|---|---|---|
| 322-039-A | 6/1989 | European Pat. Off. | 248/346.01 |

*Primary Examiner*—Leslie A. Braun
*Assistant Examiner*—Derek J. Berger
*Attorney, Agent, or Firm*—Howard & Howard

[57] ABSTRACT

A base extension assembly (20) for a Christmas tree stand (10) includes a platform (22) upon which the tree stand (10) is anchored by way of cantilever fingers (42). The cantilever fingers (42) are secured to the platform (22) by a screw (52), and prevented from rotating by a locking nub (46) which is seated in a depression (50) in the platform (22). The platform (22) can be broken down into two segments (56) for compact storage and shipment of the assembly (20). The segments (56) are joined together in an operational condition by a series of connector plates (60) with accompanying screws (62) beneath the platform (22). Additionally, an array of nut and bolt combinations (60) secure opposing end flanges (64) to help hold the segments (56) together. A bridge bar (70) spans the interior of each segment (56) to maintain structural integrity. An array of support ribs further enhance structural rigidity. The segments (56) are also joined together, one atop the other, in a stowed condition, using screws (72) through the peripheral flange (26).

33 Claims, 4 Drawing Sheets

20
22
24
26
64
66
10
12
14
16
18
28
40
42
44
46
48
50
52
54
56
74
A 64
22
20
48
50
28
70
A
72
68
4
56
74

22
30
24
74
26
56
32
72

20
22
26
28
30
32
34
36
38
40
42
44
48
52
54
56
58
60
64
66
68
70
74
A
5
7

FIG-5
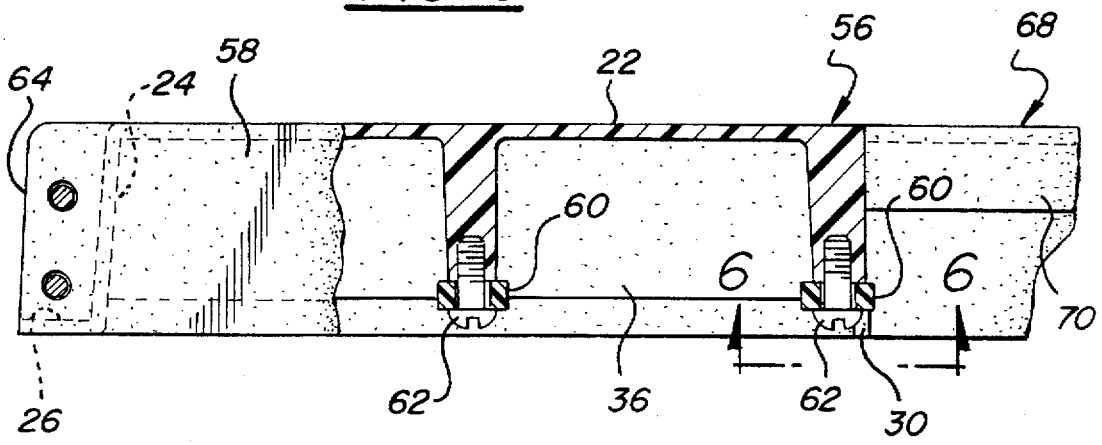
FIG-6
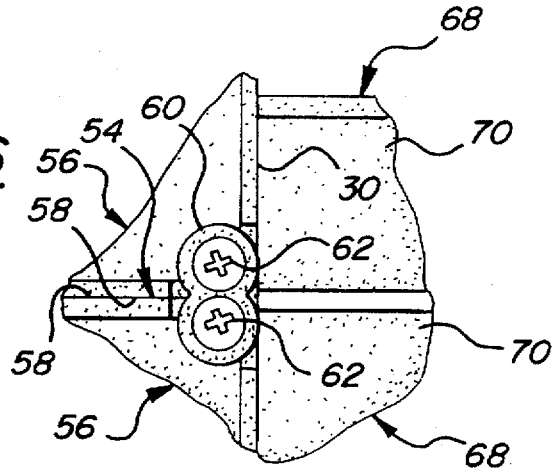
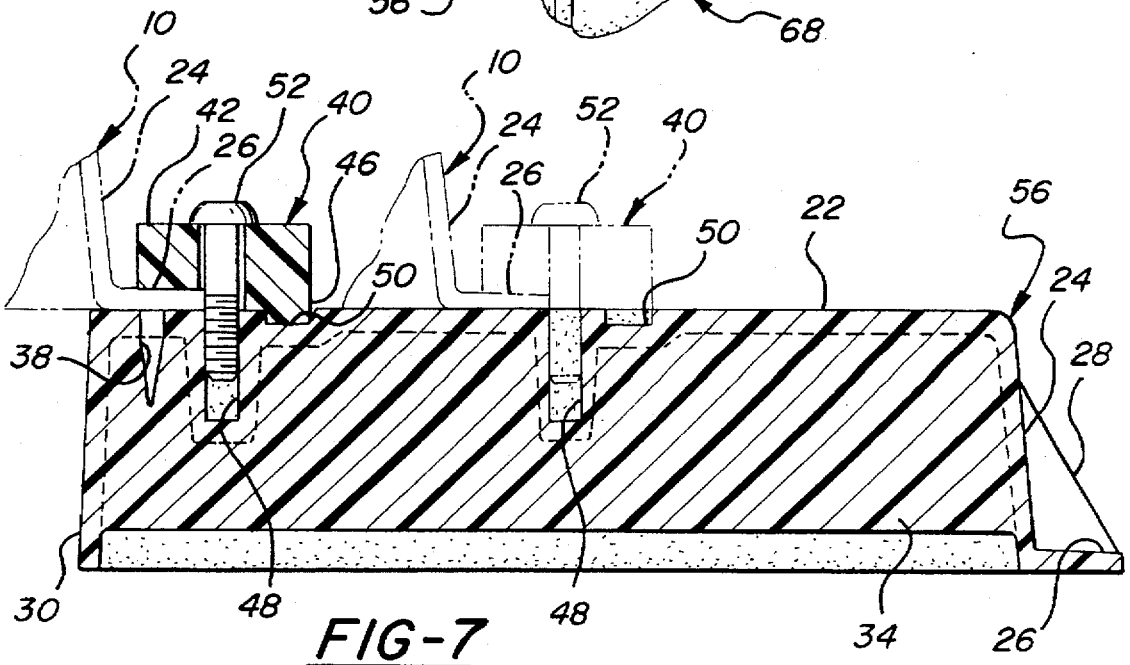
FIG-7

BASE EXTENSION FOR TREE OR DISPLAY STAND

TECHNICAL FIELD

The subject invention relates to a base extension assembly for use with a display stand which supports a Christmas tree or the like. More specifically, the subject invention is directed toward such a base extension which can be partitioned into small segments and stored compactly.

BACKGROUND OF THE INVENTION

For decorative and holiday (e.g., Christmas) purposes it is frequently desirable to display fresh cut trees or artificial trees, usually evergreens, in a natural upstanding manner. A portable tree stand is used to support the tree in the natural upstanding manner. Particularly in the case of Christmas trees, it is customary to decorate the tree with an array of ornaments and other festive articles. These ornaments and other articles can often add considerably to the weight of the tree, and depending upon placement, effect considerably the center of gravity of the tree. For example, if a Christmas tree is placed in the corner of a room such that only the visible side of the tree is decorated, and the ornaments and other articles used to decorate the tree are made from ceramic or some other heavy material predominantly on one side of the tree, a potentially dangerous condition could occur in which the tree may be easily upset.

This problem is often enhanced in the case of fresh cut trees which tend to be naturally lopsided. For such fresh cut trees, the most attractive side for display purposes is usually the heaviest side. And, for aesthetic reasons, it is always desirable to decorate with ornaments on the most attractive side of the tree. This, therefore, compounds the imbalance problem and increases the risk of upsetting the Christmas tree.

Small children and household pets are attracted to Christmas trees and are likely to pull branches or ornaments and thereby upset the tree. Certainly in the case of small children, this potential hazard must be safeguarded. Also, when Christmas trees are displayed in high traffic: areas in a home, or in churches, offices or other public centers, the special precautions should be taken to minimize the risk of upsetting the Christmas tree.

To protect against this occurrence, many people select a tree stand having a very large base measure which provides maximum stability to the Christmas tree. Unfortunately, large tree stands are very expensive and also require a considerable amount of storage space on both the store shelf and in the consumer's home or other storage area.

Alternatively, many consumers protect against the potential for tree tipping by driving spikes or screws through the tree stand directly into the floor or an enlarged piece of wood, such as plywood. Of course, not many consumers are willing to drive screws or spikes into their floor for fear of damaging the floor covering. Also, the use of an enlarged piece of plywood is met with disfavor in that it is unsightly and requires a large amount of storage space when not in use.

The potential for tipping and personal or property harm is not unique to the display of Christmas trees. Point of sale display racks can also be prone to tipping when articles of sale are either unevenly loaded or removed from the display rack. In such instances, precautions must be taken by the retail establishment to make certain that the display rack cannot tip onto an unsuspecting customer, causing personal injury.

SUMMARY OF THE INVENTION AND ADVANTAGES

The subject invention relates to a base extension assembly for a display stand of the type for supporting a Christmas tree or the like. The assembly comprises a platform for receiving a display stand. A leg extends downwardly from the platform to support the platform above a floor surface. An anchor means is provided for releasably securing the display stand to the platform. The invention is characterized by partition means for sectioning the platform into a plurality of segments for compact storage and shipment of the assembly.

The partition means of the subject invention allows the platform to be broken down into smaller units, or segments, which compactly store and thereby allows more convenient display and handling, more convenient placement on the retail shelf, and more convenient storage space for the consumer.

BRIEF DESCRIPTION OF THE DRAWINGS

Other advantages of the present invention will be readily appreciated as the same becomes better understood by reference to the following detailed description when considered in connection with the accompanying drawings wherein:

FIG. 5 is a partial cross-sectional view taken along line 5—5 of FIG. 3;

FIG. 6 is a fragmentary view in the direction of line 6—6 in FIG. 5; and FIG. 7 is a cross-sectional view taken along line 7—7 of FIG. 3 showing the anchor means in two different positions.

DETAILED DESCRIPTION OF THE PREFERRED EMBODIMENT

Figure 1:
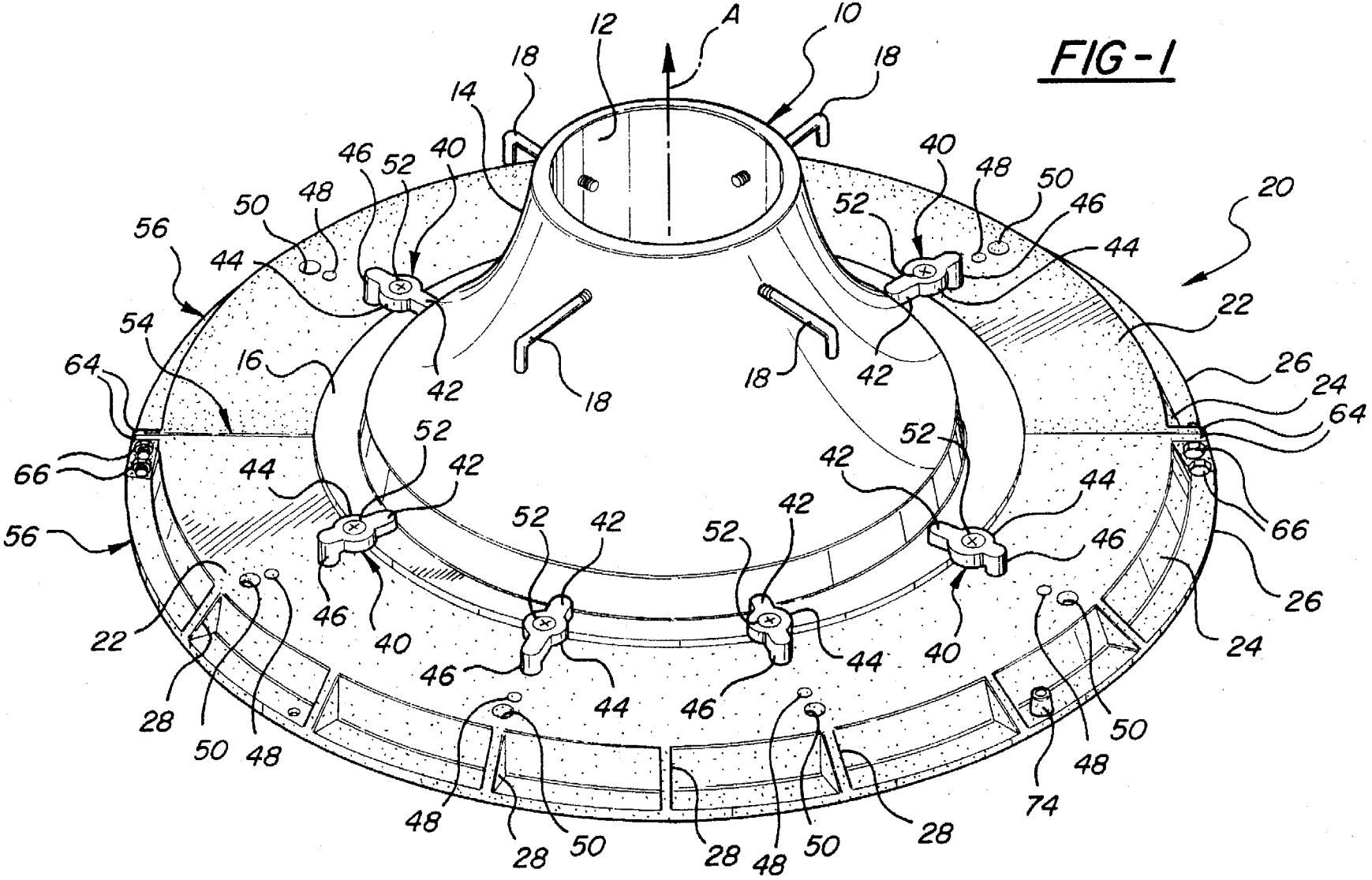
FIG. 1 is a perspective view of the base extension assembly assembled for operation with a Christmas tree stand anchored thereto.

Referring to the FIG, wherein like numerals indicate like or corresponding parts throughout the several views, a Christmas tree stand is generally indicated at 10. The tree stand 10, in the preferred embodiment, is of the type for supporting either a fresh cut or artificial Christmas tree stand in an upright natural manner during the Christmas holiday season. However, it will be appreciated that the tree stand 10 may be used for other purposes, or may be a display stand for a point of sale item or the like. Nevertheless, in the preferred embodiment the tree stand 10 includes a receptacle 12 for receiving the trunk of a tree (not shown) and an outwardly flaring sidewall 14 terminating in an annular flange 16 which is intended to contact the floor support. Screws 18, cables, collets, or some other form of restraining means holds the tree securely in the receptacle 12. Tree stands 10 of the type illustrated in the figures, are manufactured from injection molded plastic to various dimensional specifications, many of which including base dimensions at the flange 16 which are proportionately larger than that shown in FIG. 1.

A base extension assembly, generally shown at 20, is provided for attaching to the tree stand 10. The base extension assembly 20 has a substantially increased floor contact area, or footprint, so that greater stability is imparted to the Christmas tree in the stand 10. In this manner, the Christmas tree is rendered more resistant to tipping, which can be particularly important if the Christmas tree is not properly balanced or too heavily weighted, and if children or pets are likely to upset the tree. The base extension assembly 20 includes a platform 22 for receiving the flange 16 of the tree stand 10. The platform 22 forms an enlarged surface which, in the preferred embodiment shown in the figures, is substantially annular. As mentioned above, the tree stand 10 may be manufactured in different diameters. Therefore, the platform 22 is made overly large, as shown in FIG. 1, so that it may safely receive both smaller diameter tree stands and larger diameter tree stands. The platform 22 has a generally annular shape which is concentric about an imaginary vertical central axis A.

A leg 24 extends downwardly from the outer periphery of the platform 22 so as to support the platform 22 above a floor surface. Because in the preferred embodiment the platform 22 is annular, the leg 24 is substantially circular as it depends from the extreme outer edge of the platform 22. The leg 24 has a peripheral flange 26 which in turn extends outwardly from the lower extremity of the leg 24 to increase the surface area contact with the floor surface. Preferably, the subject base extension assembly 20 is molded from plastic in an injection molding operation. Braces 28 are molded integrally between the leg 24 and flange 26 to increase structural rigidity in that region.

Figure 4:
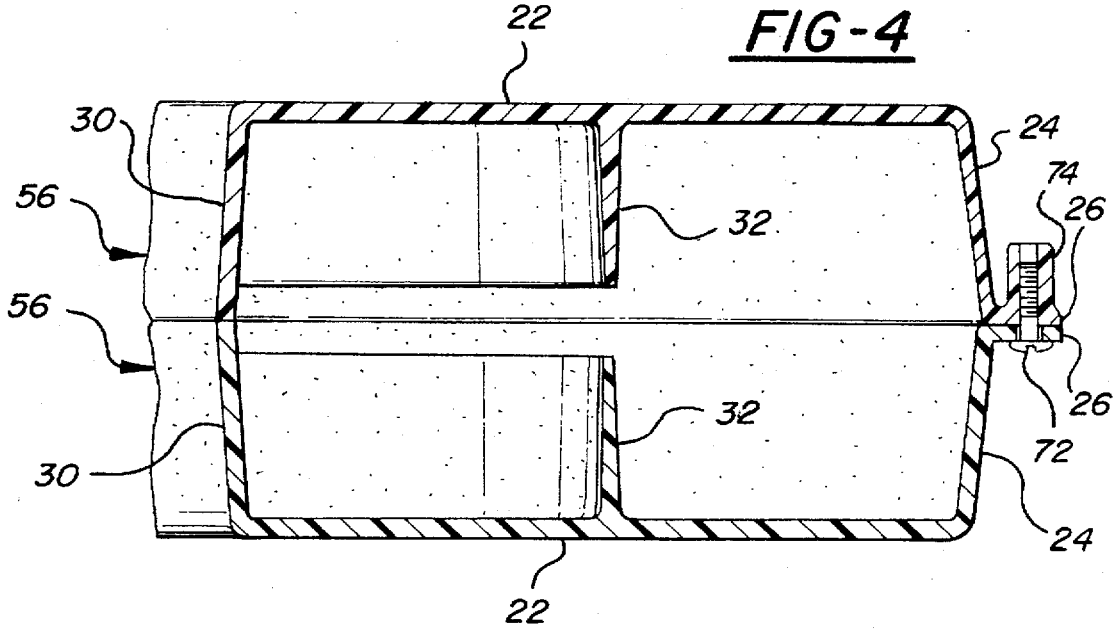
FIG. 4 is a cross-sectional view taken along line 4—4 of FIG. 2.

As shown in FIGS. 3 through 7, the base extension assembly 20 includes a series of structural ribs disposed below the platform 22 and connecting to the leg 24, so as to increase the rigidity of the assembly 20. This ribbing includes an annular inner support rib 30 depending from the platform 22. It is deemed an unnecessary use of plastic to extend the platform 22 into the central area circumscribed by the inner support rib 30. Therefore, the actual receiving surface of the platform 22 terminates at an inner edge at the intersection of the inner support rib 30. Preferably, the inner support rib 30 extends all the way to the floor support, as shown in FIGS. 4 and 7. In other words, the inner support rib 30 and the leg 24 (combined with the flange 26) are substantially equal in height measured in the direction of the central axis A, and both serve to engage the floor surface. An annular center support rib 32 depends from the platform 22, between the inner support rib 30 and the leg 24. The center support rib 32 is positioned generally midway between the inner support rib 30 and the leg 24 to further increase the structural rigidity of the platform 22. Preferably, the height of the center support rib 32 is less than the height of the inner support rib 30, such that the center support rib 32 will not touch the floor surface when in use.

Figure 3:
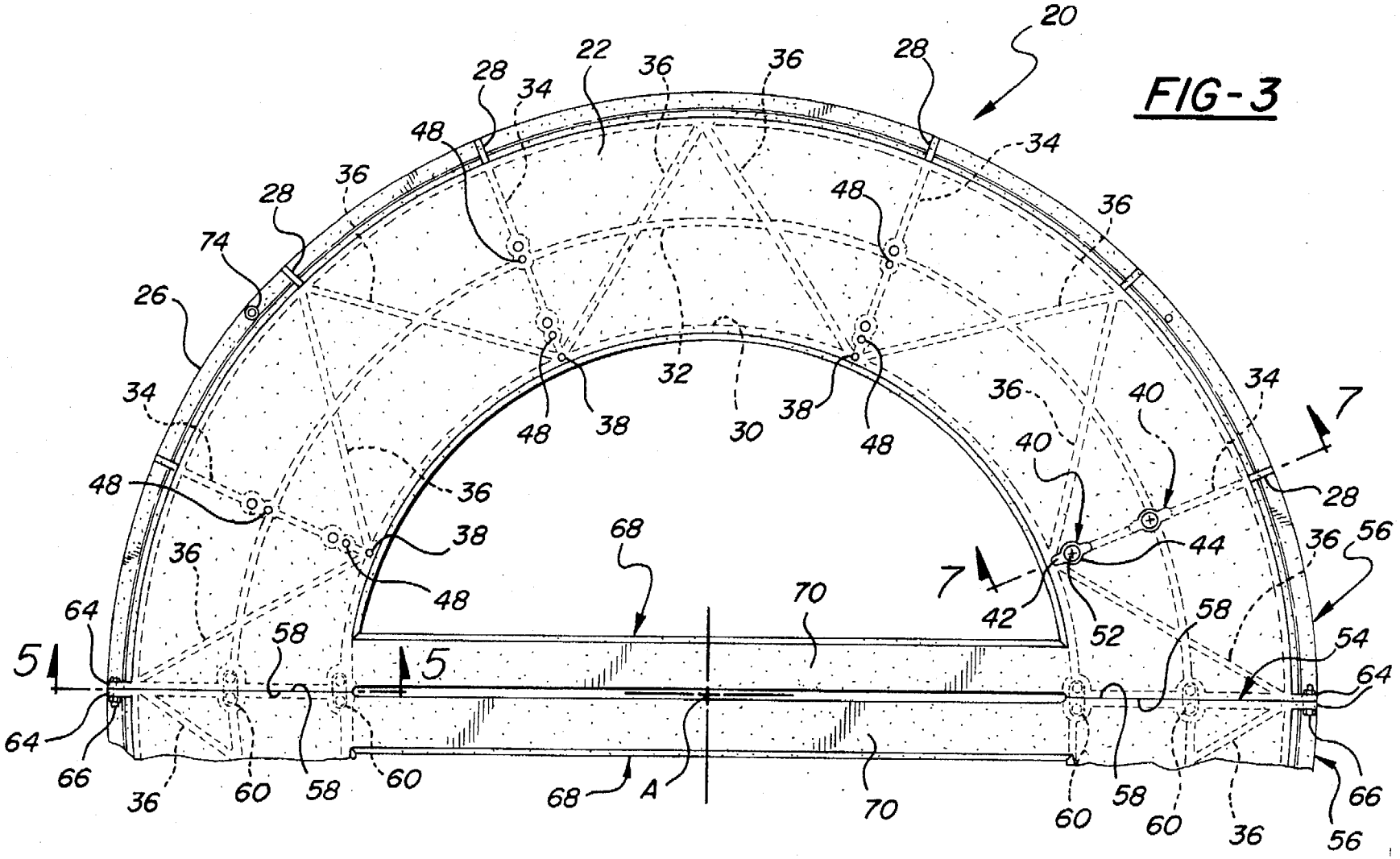
FIG. 3 is a fragmentary top view of the base extension assembly of FIG. 2.

A plurality of radial support ribs 34 also depend from the platform 22, and extend between the inner support rib 30 and the leg 24, intersecting the center rib 32. The height of each radial support rib 34 is less than the height of the inner support rib 30, and preferably is the same height as the center support rib 32. Additionally, an array of skewed support ribs 36 extend from the bottom of the platform 22, each extending between the inner support rib 30 and the leg 24, intersecting the center support rib 32 midway therebetween. The height of the skewed support ribs 36 are preferably less than the height of the inner support rib 30, such that they will not touch the floor when the base extension assembly 20 is in use. The skewed support ribs 36 are arranged, as best shown in FIG. 3, such that two are provided between adjacent radial support ribs 34. The radially inward end of each skewed support rib 36 adjoins the meeting point of a radial support rib 34 and the center support rib 30, whereas; the radially outward end of each skewed support rib 36 meets the leg 24 along with the next adjacent skewed support rib 36. Along the inner support rib 30, intersection points with merging skewed support ribs 36 and a radial support rib 34 result in a rather large mass of plastic which, according to well known molding principles, may sometimes require a small cooling cavity 38.

An anchor means, generally indicated at 40 in FIGS. 1, 3 and 7, is provided for releasably securing the tree stand 10 to the platform 22. Preferably, the anchor means 40 includes a plurality of discrete attachment points strategically located about the platform 22. A cantilever finger 42 extends from each attachment point for engaging the flange 16 of the tree stand 10. An anti-rotation means is provided for preventing the cantilever finger 42 from rotating out of engagement with the flange 16 of the tree stand 10. The anti-rotation means includes a center screw post 44 and a locking nub 46. A socket 48 is formed in the platform 22 directly above a radial support rib 34, to receive a screw 52 extending through the center post 44. A depression 50 is formed in the platform 22, immediately behind each socket 48, for receiving the locking nub 46. In this manner, the screw 52 extending through the center post 44 holds the cantilever finger 42 over top of the flange 16 of the tree stand 10, while the locking nub 46, seated in the depression 50, prevents rotation of the cantilever finger 42. When it is desired to disassemble the tree stand 10 from the base extension assembly 20, the screw 52 is backed out a short distance, enabling the locking hub 46 to be unseated from the depression 50 and the cantilever finger 42 rotated approximately 90°.

The attachment points for the anchor means 40 are preferably positioned at multiple radial locations upon the platform 22, relative to the central axis A. This is done, as mentioned above, to accommodate tree stands 10 having varying diameters. As perhaps best shown in FIG. 7, the anchor means 40 can be located at an inward most attachment point to accommodate tree stands 10 of relatively small diameter, or in the alternative can be located at an outward attachment point (shown in phantom) for tree stands having a larger diameter. It has been found that satisfactory connection of the tree stand to the base extension assembly 20 is achieved when the attachment points are equally spaced about the central axis A. Eight such attachment points are illustrated in the Figures.

Figure 2:
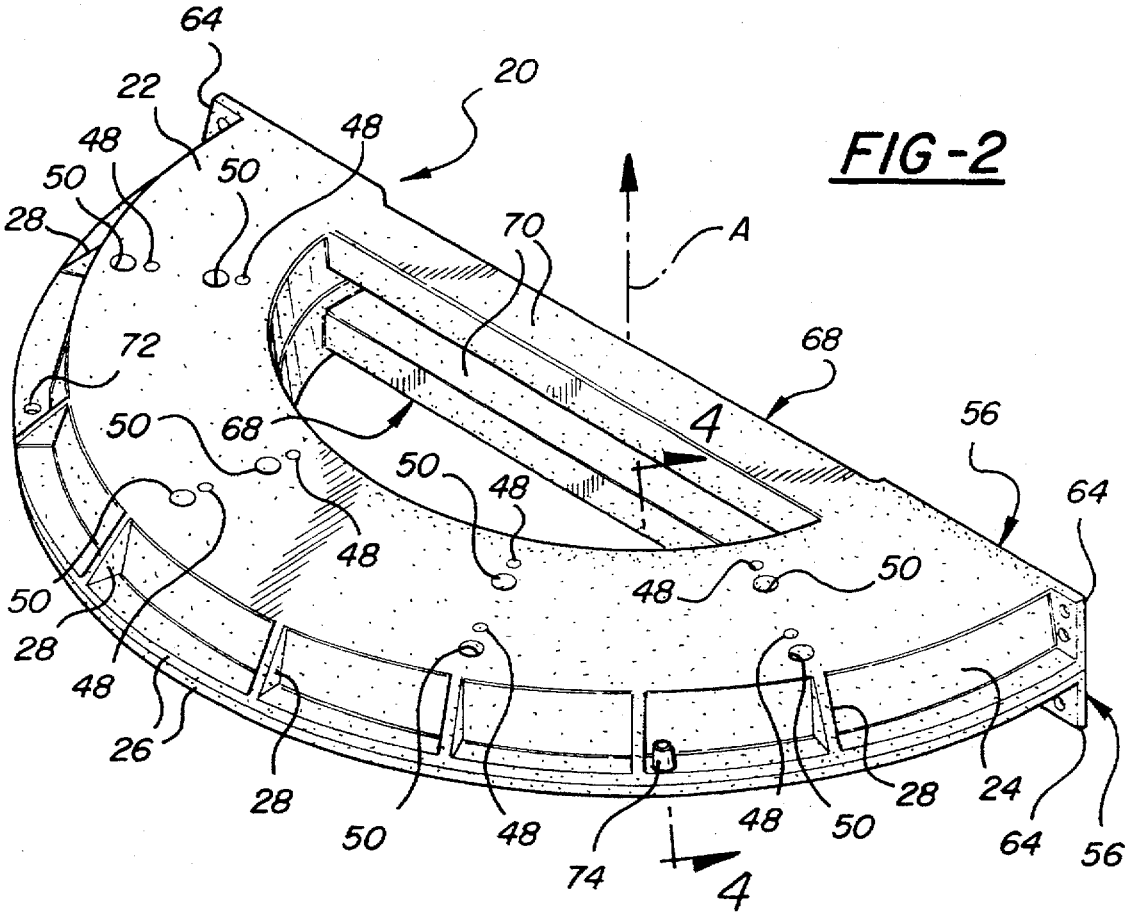
FIG. 2 is a perspective view of the base extension assembly broken down with the two platform segments fastened together for storage and shipment.

Partition means, generally indicated at 54 in FIGS. 1 through 3, is provided for sectioning the platform 22 into a plurality of segments, generally indicated at 56, for compact storage and shipment of the assembly 20. In other words, the partition means 54 enables the platform 22, and hence the entire base extension assembly 20, to be broken down into a compact size requiring less warehouse space, less shipment space, less shelf space in a retail store, and less storage space for the consumer when not in use during the Christmas season or otherwise. Each of the segments 56 include a pair of abutting surfaces 58 on opposite sides thereof for joining to the next adjacent segment 56. More specifically, the abutting surfaces 58 may comprise a smooth wall which is attended to engage the smooth wall abutting surface of the other segment 56 when the assembly 20 is connected in an operational condition as shown in FIG. 1. In the preferred embodiment, only two such segments 56 are formed, such that the partition means 54 comprises a simple parting line extending diametrically through the assembly 20. The abutting surfaces 58 are thus formed by integral end caps bridging the leg 24 and support rib configuration of each segment 56.

The partition means 54 further includes a plurality of fasteners which bridge the abutting surfaces 58 of adjacent segments 56 to connect the segments 56 to one another into the operational condition shown in FIG. 1. Such fasteners may take many forms, which those skilled in the art will readily appreciate, however a particularly expedient embodiment has been found to include a set of four connector plates 60 each having a pair of holes for receiving a screw 62 threaded into a boss at the intersection of the center support rib 32 and the abutting surface 58, as well as at the intersection between the inner support rib 30 and the abutting surface 58 of each segment 56. This is best shown in FIGS. 3, 5 and 6, wherein the connector plates 60 have a generally "FIG. 8" shape. In the preferred embodiment, the connector plates 60 and the cantilever fingers 42 are simultaneously molded with the platform via extending runners, using techniques well known in the art, to reduce manufacturing costs. In addition to the connector plates 60 and screws 62 used to connect the segments 56 to one another when the assembly 20 is in use, the fasteners of the partition means 54 may include an end flange 64 extending outwardly from each of the abutting surfaces 58 to receive a threaded bolt and nut combination 66. This arrangement is best illustrated in FIGS. 1 and 3. Thus, it will be appreciated that when in use, the segments 56 are securely attached to one another such that the platform 22 forms a complete annulus structurally capable of supporting a fully loaded tree stand 10.

A stabilizer means, generally indicated at 68 in FIGS. 2, 3 and 5, is provided for maintaining the structural integrity of each of the segments 56. The stabilizer means 66 preferably includes a bridge bar 70 spanning the inner support rib 30 adjacent the abutting surfaces 58 of each of the segments 56. That is, the bridge bar 70 of each segment 56 extends parallel to the diameter of the platform 22, which helps prevent warpage or other conditions in the segments 56 which would hinder the segments 56 from coming together to form a perfectly flat platform 22 surface during use. That is, because the base extension assembly 20 is preferably injection molded from plastic, the bridge bar 70 helps maintain alignment and increases strength of the independent segments 56. Each bridge bar 70 has a top surface which is substantially coplanar with the platform 22, and has a C-shaped cross section.

A storage means as provided for joining each of the segments 56 to one another when in the stowed, or non operational condition shown in FIGS. 2 and 4. In this stowed condition, the two segments 56 are stacked one on top the other, with their respective flange segments 26 in alignment. The stowage means includes a threaded fastener, such as a screw 72, which is received through a hole in one flange segment 26 and threaded into a receptacle 74 in the other flange segment 26. Preferably, each segment 56 is provided with one screw hole and one receptacle 74 so that, when the two are stacked in the stowed condition shown in FIGS. 2 and 4, the one receptacle 74 aligns over the hole in the other flange segment 26, with the screw 72 passing through both to connect the two segments 56 in the stowed condition. In this manner, the base extension assembly 20 can be stored in warehouses, on store shelves, and in consumers' attics in the compact stored condition shown in FIGS. 2 and 4, without becoming disconnected or lost. Also, the bridge bars 70 form a convenient carrying handle in the stowed condition.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A base extension assembly (20) for a display stand (10), said assembly (20) comprising:

a platform (22) having a broad surface area for receiving the display stand (10);

a leg (24) extending downwardly from said platform (22) to support said platform (22) above a floor surface over said broad surface area;

anchor means (40) for releasably securing the display stand (10) to said platform (22);

and characterized by partition means (54) sectioning said platform (22) into a plurality of segments (56) each smaller than said broad surface area, and storage means releasably joining each of said segments (56) to one another in a disassembled condition occupying a surface area smaller than said broad surface area for compact storage and shipment of said assembly (20).

2. An assembly (20) as set forth in claim 1 wherein each of said segments (56) includes a pair of abutting surfaces (58) on opposite sides thereof for joining to the next adjacent said segment (56).

3. An assembly (20) as set forth in claim 2 wherein said abutting surfaces (58) comprise a smooth wall.

4. An assembly (20) as set forth in claim 2 wherein said partition means (54) includes a plurality of fasteners bridging said abutting surfaces of adjacent segments (56) to connect said segments (56) together.

5. An assembly (20) as set forth in claim 4 wherein said partition means (54) includes an end flange (64) extending outwardly from each of said abutting surfaces (58) for receiving said fasteners.

6. An assembly (20) as set forth in claim 5 wherein said fasteners include a threaded bolt and an associated nut (66) extending through said end flange (64).

7. An assembly (20) as set forth in claim 6 wherein said fasteners include a plurality of connector plates (60) disposed below said platform (22) and a plurality of associated screws (62) extending through each said connector plates (62).

8. An assembly (20) as set forth in claim 4 wherein said anchor means (40) includes a plurality of discrete attachment points.

9. An assembly (20) as set forth in claim 8 wherein said anchor means (40) includes a cantilever finger (42) extending from each of said attachment points.

10. An assembly (20) as set forth in claim 9 wherein said platform (22) has a generally annular shape concentric about a vertical central axis (A).

11. An assembly (20) as set forth in claim 10 wherein said attachment points are positioned at multiple radial locations upon said platform (22) relative to said central axis (A).

12. An assembly (20) as set forth in claim 11 wherein said anchor means (40) includes anti-rotation means for preventing rotation of said cantilever finger (42) out of engagement with the display stand (10).

13. An assembly (20) as set forth in claim 12 wherein said attachment points are spaced equally about said central axis (A).

14. An assembly (20) as set forth in claim 12 wherein said anti-rotation means includes a center screw post (44) and a locking nub (46).

15. An assembly (20) as set forth in claim 14 wherein each of said attachment points includes a socket (48) in said platform (22) to receive a screw (52) through said center screw post (44) and a depression in said platform (22) to receive said locking nub (46).

16. An assembly (20) as set forth in claim 8 further including an annular inner support rib (30) depending from said platform (22).

17. An assembly (20) as set forth in claim 16 wherein said platform has a generally annular shape concentric about a vertical central axis (A) and wherein said inner support rib (30) and said leg (24) are substantially the same height measured in the direction of said central axis (A).

18. An assembly (20) as set forth in claim 16 further including an annular center support rib (32) depending from said platform (22), between said inner support rib (30) and said leg (24).

19. An assembly (20) as set forth in claim 18 wherein the height of said center support rib (32) is less than the height of said inner support rib (30).

20. An assembly (20) as set forth in claim 18 further including a plurality of radial support ribs (34) depending from said platform (22) and extending between said inner support rib (30) and said leg (24).

21. An assembly (20) as set forth in claim 20 wherein the height of said radial support ribs (34) is less than the height of said inner support rib (30).

22. An assembly (20) as set forth in claim 20 further including a plurality of skewed support ribs (36) depending from said platform (22) and each extending between said inner support rib (30) and said leg (24).

23. An assembly (20) as set forth in claim 22 wherein the height of each of said skewed support ribs (36) is less than the height of said inner support rib (30).

24. An assembly (20) as set forth in claim 22 wherein said platform (22) includes an inner edge terminating at said inner support rib (30).

25. An assembly (20) as set forth in claim 24 wherein said fasteners include a plurality of connector plates (60) disposed below said platform (22) and a plurality of associated screws (62) extending through each of said connector plates (62), and wherein said connector plates (60) are disposed along said inner support rib (30) and said center support rib (32).

26. An assembly (20) as set forth in claim 8 further including stabilizer means (68) for maintaining the structural integrity of each of said segments (56).

27. An assembly (20) as set forth in claim 26 further including an annular inner support rib (30) depending from said platform (22), and wherein said stabilizer means (68) includes a bridge bar (70) spanning said inner support rib (30) adjacent abutting surfaces (58) on each of said segments (56).

28. An assembly (20) as set forth in claim 27 wherein the number of said segments (56) equals two and each of said bridge bars (70) extends parallel to a diameter of said platform (22).

29. An assembly (20) as set forth in claim 28 wherein each of said bridge bars (70) has a top surface coplanar with said platform (22).

30. An assembly (20) as set forth in claim 8 wherein said leg (24) includes a peripheral flange (26).

31. An assembly (20) as set forth in claim 30 further including braces (28) extending between said leg (24) and said flange (26).

32. An assembly (20) as set forth in claim 1 wherein said storage means includes a threaded fastener (72) extending through said flange (26).

33. An assembly (20) as set forth in claim 32 wherein said storage means includes a hole extending through said flange (26) of one of said segments (56) and a receptacle (74) extending through said flange (26) of the other of said segments (56).

* * * * *